United States Patent [19]

Garr

[11] Patent Number: 4,641,488

[45] Date of Patent: Feb. 10, 1987

[54] APPARATUS AND METHOD FOR WRAPPING PACKAGES WITH HEAT SHRINKABLE MATERIAL

[76] Inventor: Ernest J. Garr, 3587 Powell Dr., Lafayette, Calif. 94549

[21] Appl. No.: 511,544

[22] Filed: Jul. 6, 1983

[51] Int. Cl.[4] ..... B65B 11/52; B65B 11/58

[52] U.S. Cl. ..... 53/442; 53/176; 53/229; 53/449; 53/557

[58] Field of Search ..... 53/176, 229, 399, 442, 53/449, 463, 553, 557, 582, 590, 466, 172, 586; 493/222, 963

[56] References Cited

U.S. PATENT DOCUMENTS

| | | | |
|---|---|---|---|
| 3,158,973 | 12/1964 | Monaghan | 53/229 |
| 3,523,402 | 8/1970 | West et al. | 53/229 X |
| 3,896,604 | 7/1975 | Marantz | 53/176 |

FOREIGN PATENT DOCUMENTS

| | | | |
|---|---|---|---|
| 5251289 | 10/1975 | Japan | 53/586 |
| 1193931 | 6/1970 | United Kingdom | 53/389 |
| 1434351 | 5/1976 | United Kingdom | 53/442 |

*Primary Examiner*—James F. Coan

*Attorney, Agent, or Firm*—Flehr, Hohbach, Test, Albritton & Herbert

[57] ABSTRACT

Apparatus and method for wrapping packages with heat shrinkable material, wherein one or more bands of heat shrinkable material are wrapped about each package at the same time the film material is applied. The bands are heated and shrunk with the film material to produce a tightly secured, reinforced package. The package can comprise either a single object or a group of objects wrapped together in a bundle.

15 Claims, 3 Drawing Figures

APPARATUS AND METHOD FOR WRAPPING PACKAGES WITH HEAT SHRINKABLE MATERIAL

This invention pertains generally to shrink wrapping, and more particularly to apparatus and a method for simultaneously wrapping and reinforcing packages with heat shrinkable material.

In shrink wrapping, a film of thermoplastic material which has been stretched in two directions in its manufacture is wrapped about a package and heated. The heat causes the film to return to its original dimensions, shrinking tightly about the package as it does so. The strength and integrity of packages wrapped in this manner are dependent upon the quality and thickness of the film, and the cost of the wrapping increases accordingly.

In some applications, it has been necessary to wrap packages with string or banding tape in addition to the plastic film material in order to maintain the integrity of the package. This additional string is particularly necessary when the package comprises a group of objects placed together in a bundle. The string or banding tape can be applied either before or after the film material is applied, but it requires a separate step or process.

It is in general an object of the invention to provide a new and improved method and apparatus for wrapping packages with heat shrinkable material.

Another object of the invention is to provide a method and apparatus of the above character which overcome the limitations and disadvantages of the shrink wrapping processes heretofore provided.

Another object of the invention is to provide a method and apparatus of the above character in which the need for a separate tying or banding operation is eliminated.

These and other objects are achieved in accordance with the invention by wrapping one or more bands of heat shrinkable material about the package at the same time the film is applied. The bands are heated and shrunk with the film to provide a tightly secured, reinforced package comprising either a single object or a group of objects in a bundle.

Figure 1:
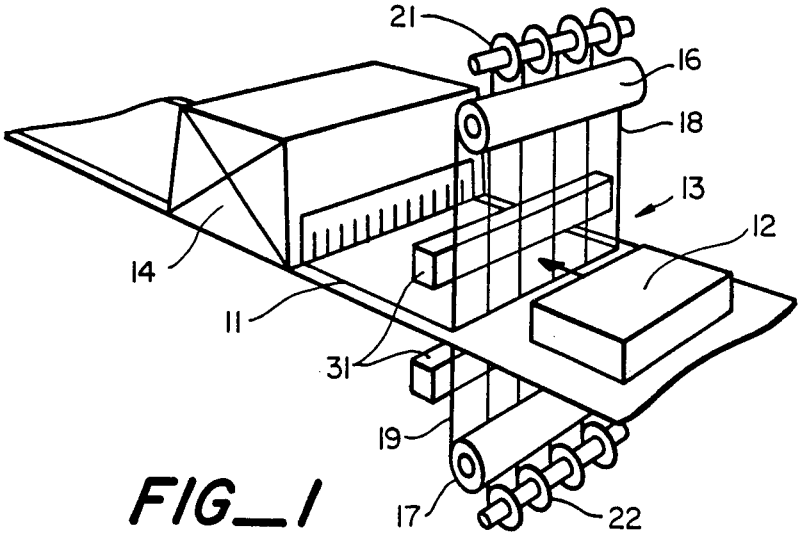
FIG. 1 is an isometric view, somewhat schematic, of one embodiment of apparatus for wrapping packages in accordance with the invention.
Figure 2:
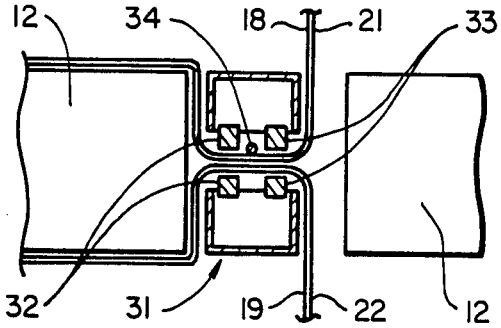
FIG. 2 is a fragmentary sectional view of a portion of the embodiment of FIG. 1.

As illustrated in the drawings, the wrapping apparatus comprises a conveyor 11 which conveys packages 12 to be wrapped along a predetermined path between a wrapping station 13 and a heat tunnel 14.

At the wrapping station, rolls 16, 17 of a heat shrinkable film material such as polyethylene are positioned on opposite sides of the conveyor and mounted for rotation about generally parallel axes which extend transversely of the conveyor path. The rolls rotate freely about the axes, and webs 18, 19 of the film material are drawn from the rolls and wrapped about each package as it is conveyed through the wrapping station.

The wrapping station also includes rolls 21, 22 of heat shrinkable ribbon which are positioned near film rolls 16, 17 and mounted for rotation about axes parallel to the axes of the film rolls. A plurality of ribbon rolls are spaced side by side along each of the axes, with corresponding rolls on the two axes being aligned vertically with each other. As discussed more fully hereinafter, the ribbon is withdrawn from the rolls and wrapped about the package with the film material to form reinforcing bands. Any number of ribbons can be employed in accordance with the number of reinforcing bands desired. In the embodiment illustrated, the ribbon adheres to the film material, and the ribbon rolls are positioned in such manner that the ribbon engages one side of the film material and adheres thereto as the two materials are withdrawn from their respective rolls and wrapped about the package.

The ribbon has a width substantially less than the width of the film material, and it can be fabricated of the same heat shrinkable material as the film or of another suitable heat shrinkable material. For greater tensile strength, the ribbon can be thicker than the film material, or it can be fabricated of a material having greater tensile properties. If desired, the ribbon can be formed by folding several layers of the film material together in an elongated strip, but it is generally preferable to use a solid ribbon or tape.

A sealing and cutting unit 31 is provided at the output of the wrapping station. This unit comprises two pairs of sealing bars 32, 33 and a cutting wire 34 which extend transversely of the conveyor path and are movable between advanced and retracted positions relative to that path for sealing and cutting the film material and the ribbon.

Heat tunnel 14 is of conventional design, and it comprises a chamber in which heated air is circulated around the package to shrink the film material and the ribbon tightly about the package.

Operation and use of the apparatus, and therein the method of the invention, can now be described. The outer ends of the film material and the ribbon drawn from rolls 16, 17 and 21, 22 are brought together and sealed to form a single continuous web of film material with bands of ribbon on one side thereof. As a package 12 is pushed onto the conveyor, the leading end of the package engages the web, and the film material drawn from rolls 16, 17 is applied to the upper and lower surfaces of the package, respectively. The ribbon from rolls 21, 22 adheres to the film material and is applied to the package with the film material.

As the package moves along the conveyor, the film material and the ribbon on the two sides of the conveyor path are drawn together and sealed together by sealing bars 32 of sealing and cutting unit 31. Thus, the package is encircled by a continuous sleeve of film material and one or more continuous bands of ribbon. At the same time, sealing bars 33 seal the film material and ribbon together to form a new web at the leading end of the next package, and cutting wire 34 severs the film material and ribbon between the packages.

After the film material and the ribbon are sealed together at the trailing end of the package, the package passes to heat tunnel 14 where the film sleeve and the ribbon bands are heated simultaneously and shrunk tightly about the package.

Figure 3:
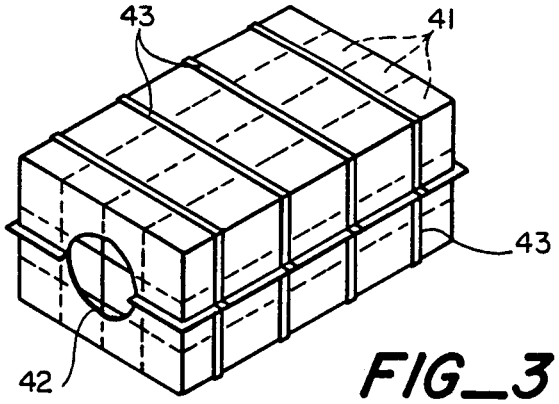
FIG. 3 is an isometric view of a package comprising a bundle of objects wrapped in accordance with the invention.

The invention has particular utility in wrapping a group of objects into a bundle as illustrated in FIG. 3. In this example, the bundle is formed by stacking a group of objects 41 side by side along the conveyor and on top of each other so that the film sleeve 42 and the reinforcing bands 43 each encircle all of the objects in the group. When the film sleeve and the reinforcing bands are heated, they shrink tightly about the objects, holding them securely together.

The invention has a number of important features and advantages. The film material and the reinforcing bands are applied to the package in a single operation, which is faster and more economical than applying string or banding tape in a separate operation. The ribbon reinforces the package and permits the use of a thinner, more economical film for a package of given strength. This method of wrapping is particularly suitable for use with packages comprising groups of objects wrapped together in bundles.

It is apparent from the foregoing that a new and improved method and apparatus for wrapping packages with heat shrinkable materials has been provided. While only certain presently preferred embodiments have been described herein, as will be apparent to those familiar with the art, certain changes and modifications can be made without departing from the scope of the invention as defined by the following claims.

I claim:

1. In apparatus for wrapping a package with heat shrinkable material; means for encircling the package with a film of heat shrinkable material, means for encircling a portion of the package with a reinforcing band of heat shrinkable material of substantially lesser width than the film, and means for simultaneously heating the film and the reinforcing band to shrink both the film and the band tightly about the package.

2. The apparatus of claim 1 wherein the means for encircling a portion of the package with a band includes means for placing a plurality of bands about the package.

3. The apparatus of claim 1 wherein the package comprises a group of objects held in a bundle by the film and the band.

4. The apparatus of claim 1 wherein the band comprises a ribbon having a width substantially less than the width of the film and a tensile strength greater than a corresponding width of the film.

5. In a method for wrapping a package with heat shrinkable material, the steps of: placing a film of heat shrinkable material about the package so that the package is encircled by the film, encircling a portion of the package with a reinforcing band of heat shrinkable material, said band having a width substantially less than the width of the film, and heating the film and the reinforcing band to shrink both the film and the band tightly about the package.

6. The method of claim 5 wherein the package comprises a group of objects held together in a bundle by the film and the band.

7. The method of claim 5 wherein a plurality of bands are placed about the package and shrunk.

8. The method of claim 5 wherein the film and the band are heated at the same time and shrunk together about the package.

9. The method of claim 5 wherein the band comprises a ribbon having a width substantially less than the width of the film and a tensile strength greater than a corresponding width of the film.

10. In apparatus for wrapping a package with heat shrinkable material: a roll of heat shrinkable film material, means supporting the roll in such manner that the film material can be withdrawn from the roll and wrapped about the package, a roll of heat shrinkable ribbon having a width substantially less than the width of the film material, means supporting the roll of ribbon in such manner that the ribbon can be withdrawn from said roll and wrapped about the package to form a reinforcing band, and means for heating both the film material and the ribbon to shrink the same about the package.

11. The apparatus of claim 10 wherein the package comprises a group of objects held together in a bundle by the film material and the ribbon.

12. The apparatus of claim 10 wherein the roll of ribbon is positioned in proximity to the roll of film material, with the ribbon dispensed from the roll adhering to the film material and being wrapped simultaneously therewith about the package.

13. The apparatus of claim 10 including means for conveying the package along a predetermined path, with the roll of film material and the roll of ribbon being mounted for rotation about axes extending transversely of the path, the film material and the ribbon being withdrawn from the rolls and wrapped about the package as the package travels along the path.

14. The apparatus of claim 13 wherein a plurality of rolls of ribbon are mounted side by side along one of the axes to form a plurality of bands about the package.

15. The apparatus of claim 13 wherein first and second rolls of film material are mounted for rotation about generally parallel axes on opposite sides of the conveyor path, first and second rolls of ribbon are mounted for rotation about generally parallel axes on opposite sides of the path, and means is provided along the path for joining the film material and the ribbon from the respective rolls together on opposite ends of the package to form a continuous sleeve of film material and a continuous band of ribbon about the package.

* * * * *